US009019802B2

(12) United States Patent
Koike

(10) Patent No.: US 9,019,802 B2
(45) Date of Patent: Apr. 28, 2015

(54) SOLAR-POWERED ELECTRONIC TIMEPIECE

(71) Applicant: Seiko Epson Corporation, Tokyo (JP)

(72) Inventor: Nobuhiro Koike, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 13/688,932

(22) Filed: Nov. 29, 2012

(65) Prior Publication Data

US 2013/0142018 A1 Jun. 6, 2013

(30) Foreign Application Priority Data

Dec. 5, 2011 (JP) ..... 2011-266244

(51) Int. Cl.
*G04B 1/00* (2006.01)
*G04C 10/02* (2006.01)
*G04C 10/04* (2006.01)

(52) U.S. Cl.
CPC ..... *G04C 10/02* (2013.01); *G04C 10/04* (2013.01)

(58) Field of Classification Search
USPC ..... 368/205; 320/101
See application file for complete search history.

(56) References Cited

U.S. PATENT DOCUMENTS 3,427,797 A * 2/1969 Negoro et al. ..... 368/205
3,724,200 A * 4/1973 Donner ..... 368/149
3,961,472 A * 6/1976 Riehl ..... 368/29
4,726,044 A * 2/1988 Perna et al. ..... 377/15
4,730,287 A * 3/1988 Yoshino et al. ..... 368/205
4,833,697 A * 5/1989 Perna et al. ..... 377/15
5,740,132 A * 4/1998 Ohshima et al. ..... 368/204
6,205,091 B1 * 3/2001 Rudolph et al. ..... 368/205
6,301,198 B1 * 10/2001 Otaka et al. ..... 368/205
6,876,602 B2 * 4/2005 Ichikawa et al. ..... 368/205
7,638,975 B2 * 12/2009 Nakamiya et al. ..... 320/134
7,876,070 B2 1/2011 Kitahara
8,692,518 B2 * 4/2014 Uchida et al. ..... 320/133

FOREIGN PATENT DOCUMENTS

JP 10-274580 A 10/1998
JP 2000-162341 A 6/2000
JP 2004-279252 A 10/2004
JP 2008-256453 A 10/2008

* cited by examiner

*Primary Examiner* — Sean Kayes
(74) *Attorney, Agent, or Firm* — Global IP Counselors, LLP

(57) ABSTRACT

The solar battery includes a plurality of cells having a same electromotive force with each other. The display device further includes a display means to display time, and a control means to control operation of the display means. The electromotive force of the solar battery is lower than a deterioration-start voltage of the rechargeable battery. The electromotive force of the cells is higher than a lower-limit driving voltage of the display device, in which a number of such cells equals a total number of cells include in the solar battery minus one. A driving voltage of the display means is lower than the aforementioned lower-limit driving voltage, and an operational voltage of the control means is lower than the aforementioned lower-limit driving voltage.

2 Claims, 4 Drawing Sheets

SOLAR-POWERED ELECTRONIC TIMEPIECE

CROSS-REFERENCE TO RELATED APPLICATIONS

This application claims priority to Japanese Patent Application No. 2011-266244 filed on Dec. 5, 2011. The entire disclosure of Japanese Patent Application No. 2011-266244 is hereby incorporated herein by reference.

BACKGROUND

1. Technical Field

The present invention relates to an electronic timepiece, specifically, a solar battery and a rechargeable battery being charged by the electricity generated by the solar battery.

2. Background Technology

In the past, it is known that the electronic timepiece includes a solar battery and a rechargeable battery, where electricity generated by the solar battery is charged in the rechargeable battery to drive the electronic timepiece (For example, refer to patent document 1). Generally, such solar battery includes a plurality of cells (electricity generating part).

By the way, in a case of an electronic timepiece that includes a rechargeable battery having a rechargeable structure, deterioration of the rechargeable battery progresses when the voltage supplied to the rechargeable battery exceeds a predetermined voltage. Therefore, a shortened life becomes an issue. In order to address this issue, there is an electronic timepiece that includes a feature for preventing the over-charging of the rechargeable battery (for example, refer to patent document 2).

The electronic timepiece disclosed in the patent document 2 includes; a rotating spindle that rotates according to the motion of the arm of user on which the electronic timepiece is worn; a gear such as rotating spindle gear in which the rotation of the rotating spindle is transferred; and an electricity generating device that generates electricity by the torque transferred by the gear. This electronic timepiece further includes a battery voltage detecting unit and a battery voltage control means. The battery voltage control means actuates a limiter to prevent supplying of the electricity generated by the electricity generating device to the rechargeable battery, when the voltage of the rechargeable battery detected by the battery voltage detecting means is higher than the predetermined value.

As just discussed, the electronic timepiece that includes a rechargeable battery having a rechargeable structure generally incorporates a over-charge prevention feature to prevent over charging of the rechargeable battery because voltage value of the charging current supplied, in compliance with the environment, to the rechargeable battery is unknown. In other words, voltage value of the electricity generating current by the electricity generating device is unknown.

Japanese Laid-open Patent Application No. 2004-279252 (Patent Document 1) and Japanese Laid-open Patent Application No. 2008-256453 (Patent Document 2) are examples of the related art.

SUMMARY

Problems to be Solved by the Invention

By the way, the foregoing over-charge prevention feature is often realized by the control IC (Integrated Circuit). And, dimension of IC (area) contributes the production cost of such IC greatly. Specifically in an analog format electronic timepiece, ratio of production cost for such IC is relatively higher amongst the production cost of movement parts. For this reason, when the control IC becomes larger by incorporating the over-charge prevention feature, production cost of the control IC increases. Furthermore, the electronic timepiece production cost increases.

Moreover, when the control IC becomes larger, a circuit board, on which the control IC is mounted, also becomes larger. For this reason, in addition to the increase in circuit board production cost, flexibility in arranging the circuit board in view of movement decreases.

The advantage of the invention is to provide an electronic timepiece that can reduce the production cost.

Means Used to Solve the Above-Mentioned Problems

In order to achieve the advantage discussed above, an electronic timepiece of the invention includes a solar battery that generates electricity by incident light, a rechargeable battery that recharges by the electricity generated by the solar battery; and a display device that operates by at least one of the electricity generated by the solar battery and a voltage output from the rechargeable battery to display time, wherein the solar battery includes a plurality of cells having a same electromotive force with each other, the display device further includes a display means to display time, and a control means to control operation of the display means, wherein the electromotive force of the solar battery is lower than a deterioration-start voltage of the rechargeable battery, The electromotive force of the cells is higher than a lower-limit driving voltage of the display device, wherein a number of such cells equals a total number of cells include in the solar battery minus one, a driving voltage of the display means is lower than the lower-limit driving voltage, and an operational voltage of the control means is lower than the lower-limit driving voltage.

The electromotive force refers to a voltage value in the electric current output from the cell or the solar battery. And, a deterioration-start voltage refers to a voltage when the rechargeable battery deteriorates due to the over-charging state of the rechargeable battery. Further, a lower limit driving voltage refers to a voltage in which the display device is able to correctly display a time. For example, in an analog format electronic timepiece that performs one-second rotation by moving the second-hand per second in a normal state (have enough battery voltage) and performs two-second rotation by moving the second-hand per two second when the battery voltage becomes lower than the predetermined value, the lower-limit driving voltage is the above-described predetermined value when the one-second rotation and two-second rotation is switched.

According to the invention, electromotive force of solar battery is lower than the deterioration-start voltage of the rechargeable battery. Therefore, even when the solar battery is placed under the high illumination environment (environment where the intensity of incident light is high), voltage higher than the deterioration-start voltage is not applied to the rechargeable battery. This prevents the generation of over-charging in the rechargeable battery. For this reason, in a case when the electronic timepiece includes a control IC, the control IC does not need to incorporate the foregoing over-charge prevention feature. Accordingly, the control IC can be downsized and production cost of the control IC as well as the electronic timepiece can be reduced.

And, because the control IC can be downsized, the circuit board, on which the control IC is mounted, also can be downsized. Accordingly, production cost of the circuit board can be reduced. This contributes to further reduction in production cost of the electronic timepiece. Furthermore, because the circuit board can be downsized, flexibility in arranging the circuit board in the electronic timepiece improves.

Also, quality of recent solar battery is stabilizing because deterioration in performance found in the early life of the solar battery used under high illuminance improved and the resistance to the environment improved. As described, even when a number of cells determined as above is lower than the number of cells in the solar battery used in the electronic timepiece in the past, the solar battery having the cells whose number is determined as above can generate electricity to drive the display device steadily. Accordingly, the electronic timepiece can operate stably.

Also, the electromotive force of cells is higher than the lower-limit driving voltage of the display device, in which the number of cells is equal to the total number of cells included in the solar battery minus one. And, a driving voltage of a display means and an operating voltage of a control means are lower than the lower-limit driving voltage, in which the display means and the control means make up the display device. Therefore, even when one of the cells in the solar battery failed to operate, enough voltage can be supplied to the display device to operate the display device. Accordingly, the display device, and furthermore, the electronic timepiece can be operated stably.

In the invention, it is preferred that the solar battery includes the three cells, voltage rating of the rechargeable battery is 1.5V, the deterioration-start voltage is 2.4V, the lower-limit driving voltage is less than or equal to 1.2V, and the electromotive force is in a range of more than or equal to 0.6V and less than 0.8V.

Preferred effectiveness of the foregoing electronic timepiece can successfully achieved by the invention. In a case when the surface area of the solar battery having three cells (sum of area where light is incident in each cell) and the surface area of the solar battery having four cells is equal, compared to the solar battery having four cells, the solar battery having three cells can increase electricity generation. Accordingly, recharging of the rechargeable battery can quickly performed.

BRIEF DESCRIPTION OF THE DRAWINGS

Referring now to the attached drawings which form a part of this original disclosure.

DETAILED DESCRIPTION OF EXEMPLARY EMBODIMENTS

Summary of Structure of an Electronic Timepiece

An embodiment of the invention will be described in detail below with reference to the accompanying drawings.

Figure 1:
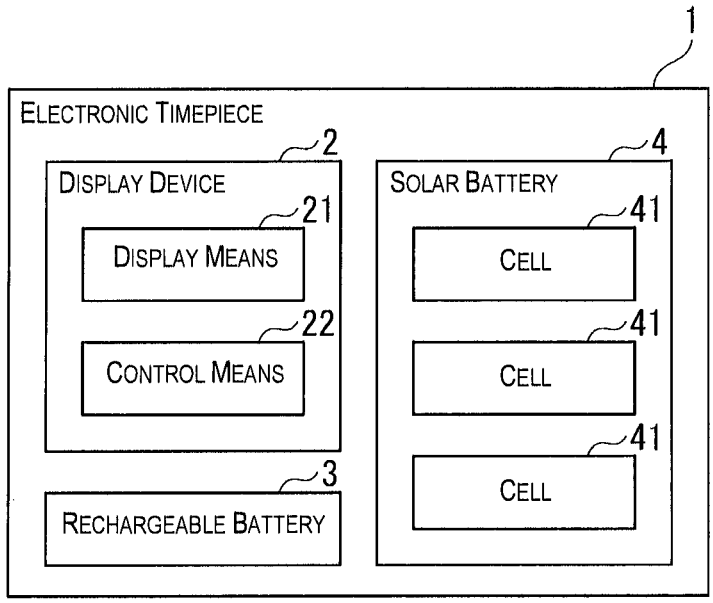
FIG. 1 shows a block diagram of an embodiment illustrating a structure of an electronic timepiece of the invention.

FIG. 1 illustrates a block diagram of the embodiment showing a structure of an electronic timepiece 1.

The electronic timepiece 1 of the embodiment is constructed as an analog format electronic timepiece and includes a solar battery and a rechargeable battery, where timekeeping and display of time are performed by electricity supplied from the solar battery or from the rechargeable battery. The solar battery generates electricity to recharge the rechargeable battery also.

Such electronic timepiece 1 includes a display device 2, a rechargeable battery 3, and a solar battery 4 as shown in FIG. 1.

Structure of Display Device

The display device 2 operates to display time by electricity generated by the solar battery 4 or electricity supplied from the rechargeable battery 3. The display device 2 includes a display means 21 that displays time and a control means 22 that controls operation of the display means 21.

The detailed illustration of the display means 21 is omitted, however, the display means 21 includes an indicator needle, a step motor that rotates the indicator needle, and a movement having a plurality of gears. A preferred range of operational voltage for this step motor is set at more than 0V and less than or equal to 0.8V. For this reason, a driving voltage of the display means 21 is lower than a later discussed lower-limit driving voltage 1.2V of the display device 2. In the embodiment, the range of operational voltage for the step motor is set at more than 0V and less than or equal to 0.8V in order to set the driving voltage of the display means 21 to be lower than the lower-limit driving voltage (1.2V). However, the range of the operational voltage of the step motor should be appropriately adjusted accordingly. For example, the step motor is operational even when voltage above 2.4V is applied.

Because this electronic timepiece 1 is structured in the analog format electronic timepiece, the display means 21 is structured to include the indicator needle and the movement. However, when the electronic timepiece 1 is structured in a digital format electronic timepiece, the display mean 21 is constructed as a liquid crystal panel and the like display device.

The control means 22 keeps internal time and controls the display means 21 in accordance with the internal time. Specifically, the control means 22 controls the aforementioned step motor to have the display means 21 to display the internal time. This control means 22 is constructed as a circuit board on which a control IC that processes the control operation is mounted. A preferred range of operational voltage for this control means 22 (control IC) is set in a range of more than and equal to 0.6V and less than 3V, and the operational voltage in a normal activation state is approximately 1.1V. For this reason, in this embodiment, the operational voltage in the normal activation state is set below 1.2V which is the later discussed lower-limit driving voltage of the display device 2. Further, operation of control IC, which structure as the control means 22, is possible even when voltage having more than the lower-limit driving voltage (1.2V) is applied.

On the other hand, when the electronic timepiece 1 is structured as the digital format electronic timepiece, the control means 22 controls the aforementioned display devices to have the display devices to display the internal time.

This display device 2 changes the operation system according to the voltage supplied from the rechargeable battery 3 (battery voltage of the rechargeable battery 3). Specifically, when the supplied voltage from the rechargeable battery 3 is above a predetermined value, the one-second operation is performed, where a second-hand of the aforementioned indicator needle is rotated per second. Normal state of the electronic timepiece 1 is a state when this one second rotation is performed. On the other hand, when the supplied voltage is below the predetermined value, the two-seconds operation is performed, in which the second-hand is rotated per two-seconds, to prevent electricity consumption. This predetermined value is the lower-limit driving voltage of the invention and set in a range of more than 0V and less than or equal to 1.2V. In this embodiment, the lower-limit driving voltage is set at 1.2V.

Also, when the electronic timepiece 1 is constructed as the digital format electronic timepiece, the lower-limit driving voltage is the voltage where the display device 2 is able to display the time normally. Further, the driving voltage of the display means is the driving voltage of the aforementioned display devices. And, the operational voltage of the control means 22 is the voltage that enables timekeeping of the internal time as well as operation control of the display devices.

Structure of the Rechargeable Battery

The rechargeable battery 3 is constructed, for example, by a titanium-lithium ion battery and outputs the electricity to the display device 2 to operate the display device 2. In this embodiment, the rechargeable battery 3 is a 1.5V type rechargeable battery.

This rechargeable battery 3 is recharged by the electric current supplied from the solar battery 4. However, when the voltage of the electric current (recharging current) is above a predetermined value, over-charging develops and that accelerates the deterioration. This predetermined value corresponds to the deterioration-start voltage of the invention. In this embodiment, the deterioration-start voltage of the rechargeable battery 3 is 2.4V. Specifically, a preferred range of working voltage for the rechargeable battery 3 is set at more than or equal to 0.5 V and less than 2.4V. For this reason, deterioration develops in the rechargeable battery 3 when voltage of more than or equal to 2.4V is applied.

The withstanding voltage of the rechargeable battery 3 is often in a range of more than or equal to 2.6V and less than or equal to 2.8V. However, apparent reduction in capacity and the like quality loss develops when the rechargeable battery is operated near this range.

Structure of Solar Battery

The solar battery 4 generates electricity by the incident light and outputs the generated electric current to the control means 22. This generated electric current is supplied to the rechargeable battery 3 such that the rechargeable battery 3 is recharged. This solar battery 4 includes an electricity generating part that is made of three cells 41, where each of the cells 41 has the same electricity generating ability. More specifically, in this embodiment, the electromotive force of each the cells 41 is the same, and is more than or equal to 0.6V and less than 0.8V.

Figure 2:
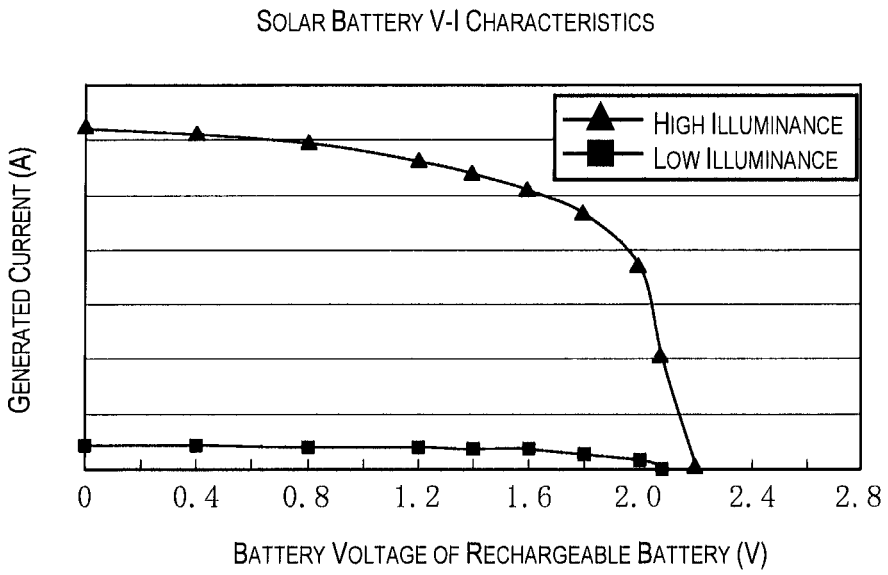
FIG. 2 shows a diagram illustrating an electricity generation feature of a solar battery in the embodiment.

FIG. 2 is a diagram illustrating the V-I characteristic of solar battery 4 in the low illuminance environment and in the high illuminance environment. In FIG. 2, the horizontal axis indicates the battery voltage of the rechargeable battery 3 and the vertical axis indicates the generated electric current of the solar battery 4.

As shown in FIG. 2, in this solar battery 4, when the battery voltage of the rechargeable battery 3 is low, the value of generated electric current in the high illuminance environment (incident light per unit area is high) and in the low illuminance environment (incident light per unit are is low) is different. More specifically, the amount of generated electricity in the high illuminance environment is larger than the low illuminance environment.

However, as the battery voltage of the rechargeable battery 3 becomes larger, differences in the values of the generated electric current in the high illuminance environment and in the low illuminance environment becomes smaller. As discussed, the solar battery 4 changes the amount of electricity generated in accordance with the battery voltage of the rechargeable battery 3. However, the electromotive force of the rechargeable battery 4 is the same whether it is in the high illuminance environment or in the low illuminance environment.

As the battery voltage of rechargeable battery 3 approaches its maximum (close to fully recharged), electricity generation by the solar battery 4 drops down, and when the battery voltage reaches its maximum, electricity supplied to the rechargeable battery 3 becomes almost zero.

Figure 3:
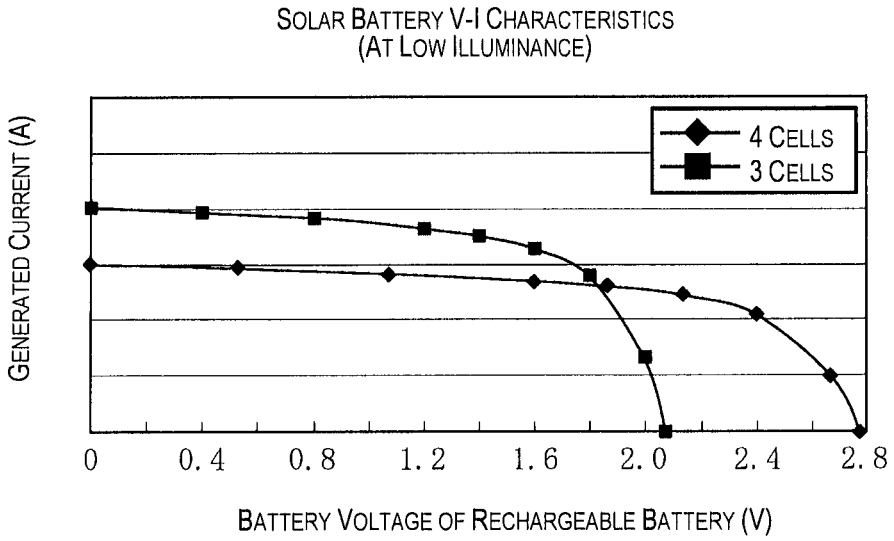
FIG. 3 shows a diagram illustrating electricity generation features of a solar battery having three cells and a solar battery having four cells.

FIG. 3 is a diagram illustrating respective electricity generation characteristics of solar battery having three cells and four cells. In FIG. 3, the electricity generation characteristic in the low illuminance environment is illustrated. Same trend as in FIG. 3 can be found in the high illuminance environment. And, horizontal axis and the vertical axis are same as FIG. 2.

As shown in FIG. 3, in a case when a surface area of an entire solar battery having three cells (sum of the areas where light is incident in each cell) and a surface area of an entire solar battery having four cells are the same, the electromotive force of the solar battery having three cells becomes lower than that of the solar battery having four cells.

However, surface area of each cell in the solar battery having three cells is larger than that of the solar battery having four cells. For this reason, there is a range (range of battery voltage of the rechargeable battery 3), in which the generated electricity (more specifically, the amount of generated electricity) by the solar battery having three cells becomes higher than that of the solar battery having four cells. In this range, the battery voltage of the rechargeable battery 3 is approximately at less than or equal to 1.8V.

For this reason, in a state when the battery voltage of the rechargeable battery 3 is less than or equal to 1.8V, the amount of generated electricity is larger for the solar battery having three cells than that of the solar battery having four cells. From this, the rechargeable battery 3 can be quickly recharged by using the solar battery having three cells in the above discussed state. Further, the electronic timepiece 1 of the embodiment uses the solar battery 4 having three cell 41.

Determining the Number of Cells in the Solar Battery

The method of determining the number of cell 41 in the solar batter 4 is explained as follows.

In the electronic timepiece 1 of the embodiment, prevention of developing the over-charge in the rechargeable battery 3 is achieved by not having the over-charge prevention feature in the control IC that makes up the control means 22. This is because the solar battery 4 having a number of cells 41 whose number is determined by the following conditions is used.

By the way, the electromotive force of each 41 incorporated in the solar battery 4 are the same as discussed earlier.

First condition requires the electromotive force of all cells 41 included in the solar battery 4 is lower than the deterioration-start voltage (in this embodiment, it is 2.4V) of the rechargeable battery 3. Depending on the electricity generation state of the solar battery 4 that complied with the environment of the electronic timepiece 1, over-charging in the rechargeable battery 3 develops frequently if the electromotive force of all cells 41 stay above the deterioration-start voltage. Therefore, it is to prevent the development of over-charging.

Second condition requires that the electromotive force of cells 41 is higher than the lower-limit driving voltage (in this embodiment, it is 1.2V) of the display device 2, in which the number of cells 41 should equal the total number of cells 41 in the solar battery 4 minus one. This is to enable the normal operation of display device 2, even when one of cells 41 is failed to operate and is unable to generate electricity. In detail, the normal operation of the display device 2 is achieved by the remaining other cell 41 that are enabled to generate electricity normally.

Third condition requires that the driving voltage of the display means 21 (in detail, the step motor that makes up the display means 21) is lower than the lower-limit driving voltage of the display device 2. Further, fourth condition requires that the driving voltage (voltage in a normal activation state) of the control means 22 is lower than the lower-limit driving voltage of the display device 2. This is to secure a voltage to display time by the display device 2 appropriately.

Figure 4:
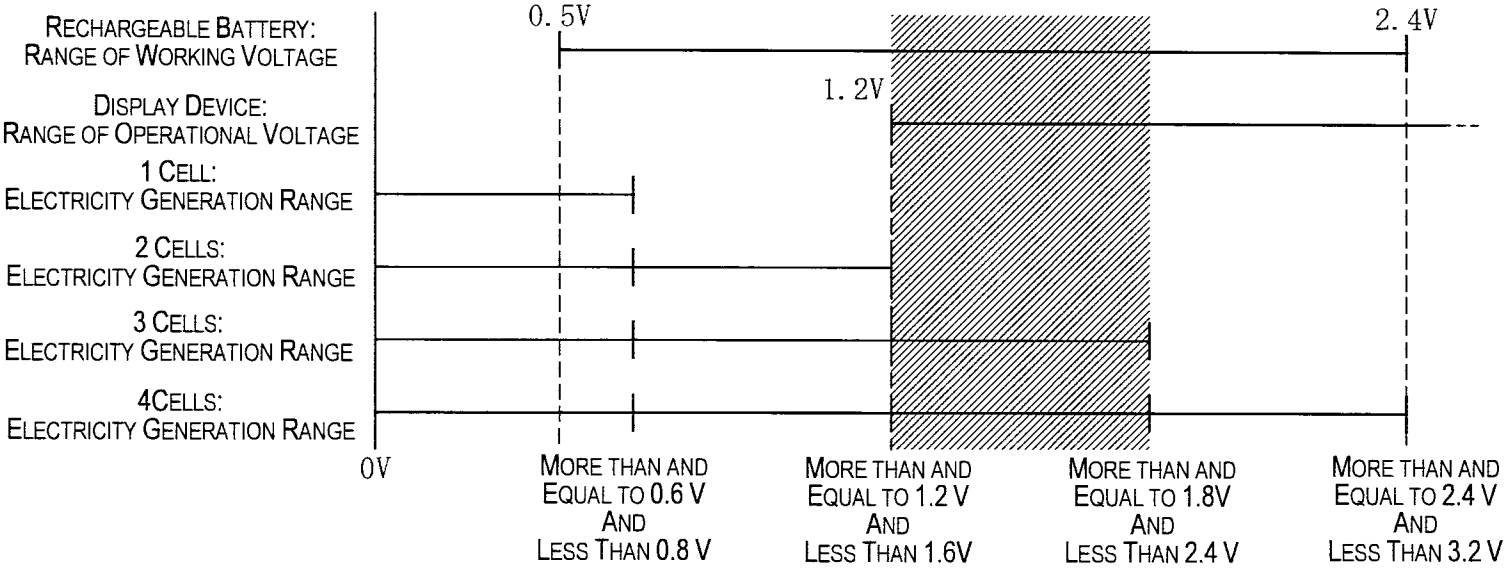
FIG. 4 shows a diagram illustrating a desired range of working voltage for a rechargeable battery, a desirable range of driving voltage for a display device, and a relationship between the electromotive force and a plurality of cells in the embodiment.

FIG. 4 is a diagram illustrating the relationship; desirable range of working voltage for the rechargeable battery 3 and the operational range for the display device 2 in view of the electromotive force by a plurality of cells 41.

In this embodiment, the voltage rating of the rechargeable battery is 1.5V as discussed earlier. In addition, the deterioration-start voltage of the rechargeable battery 3 is 2.4V and the lower-limit driving voltage is 1.2, as indicated in FIG. 4. Further, the electromotive force of single cell 41 is in a range of more than or equal to 0.6V and less than 0.8V.

Based on the above, such as the rechargeable battery 3 having its deterioration-start voltage at 2.4V and the electromotive force of single cell 41 lies in the range of more than or equal to 0.6V and less than 0.8V, and based on the aforementioned first condition, the required number of cells 41 for the solar battery 4 is less than or equal to three (3).

Moreover, because the lower-limit driving voltage of the display device 2 is 1.2V and the electromotive force of single cell 41 lies in the range of more than or equal to 0.6V and less than 0.8V, more than or equal to two (2) cells 41 is required. And, based on the number of cells 41 and the aforementioned second condition, the number of cells 41 required for the solar battery 4 is more than or equal to three (3).

For this reason, range of cell numbers required for the solar battery 4 is the oblique lined portion in FIG. 4. Therefore, the number of cells becomes three (3). By satisfying the second condition and in combination with the third and fourth conditions, the display device 2 (the display means 21 and the control means 22) drives and operates normally.

Accordingly, the display device 2 is enabled to operate normally and to prevent the development of over-charging without incorporating the over-charge prevention feature in the rechargeable battery 3. This is achieved by incorporating the three (3) cells 41 having same electromotive force in the solar battery 4.

Advantages of the Present Embodiment

The electronic timepiece 1 according to the aforementioned embodiment, the following advantages can be expected.

The electromotive force of the solar battery 4 is lower than the deterioration-start voltage of the rechargeable battery 3. Because of this reason, no voltage having a higher than the deterioration-start voltage is applied to the rechargeable battery 3, whether the solar battery 4 is placed in the high illuminance environment or in the low illuminance environment. It is therefore, enables to prevent the development of over-charging in the rechargeable battery 3. Accordingly, there is no need to incorporate the over-charging prevention feature in the control IC that makes up the control means 22. Therefore, the production cost of the control IC and eventually the electronic timepiece 1 can be reduced.

Also, the control IC can be downsized because there is no need to build the over-charge prevention feature in the control IC. By this, the circuit board, on which the control IC is mounted, can be downsized. Accordingly, reduction in production cost of the circuit board as well as the electronic timepiece 1 can be achieved. Furthermore, flexibility in arranging for mounting the circuit board to the foregoing movement (flexibility in arranging the circuit board in the electronic timepiece 1) improves.

In addition, an electromotive force of the cells 41 is higher than the lower-limit driving voltage of the display device 2, where the number of cells 41 is equal to the total number of cells 41 that the solar battery 4 includes minus 1.

Also, a driving voltage of the display means 21 and an operating voltage of control means 22 are lower than the lower-limit driving voltage, where the display means 21 and the control means 22 construct the display device 2.

By this, even when one of three cells 41 contained in the solar battery 41 failed to operate, the display device 2 can be operated reliably by electric current generated by remaining other cells 41 that can normally generate electricity.

Accordingly, the electronic timepiece 1 can be steadily operated.

In a case when the surface area of the solar battery 4 having three cells and the surface area of the solar battery having four cells 41 is equal, compared to the solar battery having four cells, the solar battery 4 having three cells 41 of the present embodiment can increase electricity generation as shown in foregoing FIG. 3. Accordingly, recharging of the rechargeable battery 3 can quickly performed.

Variation of the Embodiment

This invention is not limited to the foregoing embodiment and can include various modifications and improvements thereof that can achieve the advantage of the invention.

The embodiment of the invention used the solar battery 4 having three cells 41 based on the deterioration-start voltage of the rechargeable battery 3, lower-limit driving voltage of the display device 2, lower-limit driving voltage of the display means 21 and the driving voltage of the control means 22. However, the invention is not limited to this embodiment. In other words, solar battery having cells 41, in which the number of cells 41 is determined by the voltage value, should be used.

In the embodiment, the rechargeable battery of 1.5V type is used and the deterioration-start voltage of the rechargeable battery is set at 2.4V, lower-limit driving voltage is set at 1.2V and the electromotive force generated by any single cell 41 is set in a range of more than or equal to 0.6V and less than 0.8V. However, the invention is not limited to the numbers discussed above and each voltage value is changeable depending on the property and the like of each component used in the electronic timepiece. For example, the deterioration-start voltage is not limited to 2.4V and can be other value obtained by the property of the rechargeable battery. Also, lower-limit driving voltage is not limited to 1.2V and can be other value obtained by the display device or the like component. For example, the lower-limit driving voltage can be in a range of more than 0V and less than or equal to 1.2V, or the value outside of this range. Further, the electromotive force of cells in the solar battery is not limited to the range of more than or equal to 0.6V and less than 0.8V and such range can be outside of this particular range. In other words, solar battery having cells, where the number of cells is determined by the value of each parameter, should be used.

The embodiment of the invention used the 1.5V type rechargeable battery. However, the invention is not limited to this type and rechargeable battery having other voltage type could be used. For example, in a case when a 3V type rechargeable battery is used, if a lower-limit driving voltage of the display device 2 is set less than or equal to 1.8V and a deterioration-start voltage of the rechargeable battery is set at 3.3V, solar battery having four cells can be used, in which an electromotive force of the cells is in a range of more than or equal to 0.6V and less than equal to 0.8V. Such 3V type rechargeable battery includes, for example, a lithium ion rechargeable battery which uses lithium cobalt oxide.

The embodiment of the invention discusses the analog format electronic timepiece, however the invention is not limited to this. More specifically, the invention can be adapted to a digital format electronic timepiece.

What is claimed is:

1. A solar-powered electronic timepiece, comprising:

a solar battery configured to generate electricity by incident light, the solar battery including a plurality of cells having a same electromotive force with each other, the electromotive force of each of the cells falling within a range having lower and upper limits in an illuminance environment above an illuminance level;

a rechargeable battery configured to recharge by the electricity generated by the solar battery; and a display device configured to be operated with a driving voltage by at least one of the electricity generated by the solar battery and a voltage output from the rechargeable battery to display time, the display device being further configured to be operated in a predetermined state while the driving voltage exceeds a predetermined lower-limit driving voltage, the display device further including a display unit configured to display time, the display unit having an indicator needle, a step motor that rotates the indicator needle, and a movement that includes a plurality of gears, and a control unit configured to control operation of the display unit, an upper limit of a total electromotive force of the solar battery being lower than a predetermined voltage indicative of a deterioration-start voltage of the rechargeable battery over which the rechargeable battery is overcharged, a lower limit of a total electromotive force of a part of the cells being higher than the predetermined lower-limit driving voltage of the display device, with a number of the part of the cells being less than a total number of the cells in the solar battery by one, a driving voltage of the display unit being lower than the predetermined lower-limit driving voltage of the display device, and an operational voltage of the control unit being lower than the predetermined lower-limit driving voltage of the display device.

2. The solar-powered electronic timepiece according to claim 1, wherein the total number of the cells in the solar battery is three, the rechargeable battery has a voltage rating of 1.5V, the predetermined voltage indicative of the deterioration-start voltage of the rechargeable battery is 2.4V, the predetermined lower-limit driving voltage of the display device is less than or equal to 1.2V, and the electromotive force of each of the cells falls within the range of more than or equal to 0.6V and less than 0.8V.

* * * * *